US006011472A

United States Patent [19]

Pendergraph et al.

[11] Patent Number: 6,011,472

[45] Date of Patent: Jan. 4, 2000

[54] THEFT-DETERRENT TAPE RULE PACKAGE

[75] Inventors: Melvin A. Pendergraph, Manchester; Alan T. Byrne, Wethersfield; Richard H. Hart, Berlin; Edmund J. Czopor, Jr., Burlington, all of Conn.

[73] Assignee: The Stanley Works, New Britain, Conn.

[21] Appl. No.: 09/243,444

[22] Filed: Feb. 3, 1999

Related U.S. Application Data

[60] Provisional application No. 60/077,009, Mar. 6, 1998.

[51] Int. Cl.[7] ..... G08B 13/14; B65D 85/00

[52] U.S. Cl. ..... 340/568.1; 340/572.8; 340/568.8; 206/459.1; 206/807

[58] Field of Search ..... 340/568.1, 568.4, 340/568.5, 568.6, 568.7, 568.8, 572.1, 572.8, 572.9, 566; 206/308.2, 463, 705, 307, 459.1, 459.5, 461, 807

[56] References Cited

U.S. PATENT DOCUMENTS

| | | | |
|---|---|---|---|
| D. 333,613 | 3/1993 | Theros | D9/415 |
| 2,872,030 | 2/1959 | Dumont | 206/45.14 |
| 3,408,234 | 10/1968 | Ririe, Jr. | 136/181 |
| 3,523,397 | 8/1970 | Carey et al. | 53/30 |
| 3,881,601 | 5/1975 | Walus et al. | 206/497 |
| 4,510,490 | 4/1985 | Anderson, III et al. | 340/572.1 |
| 4,534,465 | 8/1985 | Rothermel et al. | 206/443 |
| 4,723,656 | 2/1988 | Kiernan et al. | 206/705 |
| 4,816,735 | 3/1989 | Cook et al. | 320/110 |
| 4,896,770 | 1/1990 | Calcerano et al. | 206/705 |
| 4,958,731 | 9/1990 | Calcerano | 206/705 |
| 4,962,369 | 10/1990 | Close | 340/568.1 |
| 4,980,670 | 12/1990 | Humphrey et al. | 340/551 |
| 5,029,705 | 7/1991 | Schmidt et al. | 206/705 |
| 5,109,217 | 4/1992 | Siikarla et al. | 340/572.1 |
| 5,111,186 | 5/1992 | Narlow et al. | 340/572.5 |
| 5,129,516 | 7/1992 | Theros | 206/463 |
| 5,143,215 | 9/1992 | Hartley et al. | 206/705 |
| 5,311,989 | 5/1994 | Ward et al. | 206/705 |
| 5,313,192 | 5/1994 | Ho et al. | 340/551 |
| 5,341,125 | 8/1994 | Plonsky et al. | 340/572.3 |
| 5,357,240 | 10/1994 | Sanford et al. | 340/572.8 |
| 5,367,289 | 11/1994 | Baro et al. | 340/566 |
| 5,460,266 | 10/1995 | Mundorf et al. | 206/807 |
| 5,586,657 | 12/1996 | Ward et al. | 340/572.1 |
| 5,601,188 | 2/1997 | Dressen et al. | 206/308.2 |
| 5,626,226 | 5/1997 | Gardiner et al. | 206/349 |
| 5,871,100 | 2/1999 | Ward | 340/572.1 |

*Primary Examiner*—Jeffery A. Hofsass
*Assistant Examiner*—Van T. Trieu
*Attorney, Agent, or Firm*—Pillsbury Madison & Sutro LLP

[57] ABSTRACT

A theft-deterrent tape measure package, comprising a tape measure device including a coilable tape rule contained in a housing, and a belt clip secured to the housing; a surveillance tag carrier structure secured to the belt clip and defining a compartment; and an electronic article surveillance tag secured within the compartment. The surveillance tag carrier structure is of high strength plastic material inhibiting separation thereof from the belt clip and inhibiting manual access to the electronic article surveillance tag. The surveillance tag carrier structure requires cutting or otherwise destroying of the plastic material with an implement to enable separation thereof from the belt clip or manual access to the electronic surveillance tag.

17 Claims, 4 Drawing Sheets

THEFT-DETERRENT TAPE RULE PACKAGE

This application claims the benefit of U.S. Provisional Application No. 0/077,009, filed Mar. 6, 1998.

FIELD AND BACKGROUND OF THE INVENTION

The present invention relates to a theft-deterrent package for a tape measure. The package carries an anti-theft device, such as an electronic article surveillance tag, wherein the package and the tape measure cannot be separated from one another without cutting the package with a knife or scissors, thus preventing separation of the tag from the tape measure.

Tape measures pose a significant theft problem in retail stores. With conventional tape measure packaging, e.g., using cardboard and/or plastic wrap, shop-lifters have been known to tear the package off the tape measure and wear the tape measure out of the store, clipped to the individual's belt.

Electronic article surveillance (EAS) tags have been used in retailing to reduce theft. The tags, which are attached to the retail article or its packaging, trip an alarm-sounding sensor of an EAS detection system when an attempt is made to remove the article from the store, unless the EAS tag is first disarmed by store personnel. Of course, if the tag becomes separated from the article, it is ineffective to prevent theft of the article.

EAS tags have been applied to tape measure packages displayed for sale in order to deter theft. EAS tags are only effective, however, if the tape measure remains with the part of the package carrying the tag. In present tape measure packages, separation of the tape measure from the EAS tag has been relatively easy to accomplish, thus enabling the tape measure to be removed from the store without tripping the EAS detection system sensor.

Accordingly, the need exists for a tape measure package that includes an EAS tag that cannot be separated easily from the tape rule measure.

SUMMARY OF THE INVENTION

It is an object of the present invention to overcome the problem noted above. This object is achieved in accordance with the principles of the present invention by providing a theft-deterrent tape measure package, comprising a tape measure device including a coilable tape rule contained in a housing, and a belt clip secured to the housing; a surveillance tag carrier structure secured to the belt clip and defining a compartment; and an electronic article surveillance tag secured within the compartment. The surveillance tag carrier structure is of high strength plastic material inhibiting separation thereof from the belt clip and inhibiting manual access to the electronic article surveillance tag. The surveillance tag carrier structure requires cutting or otherwise destroying of the plastic material with an implement to enable separation thereof from the belt clip or manual access to the electronic surveillance tag.

The present invention is particularly suited for tape measure packages that provide a cardboard backing that facilitates display of the tape measure for sale. In accordance with this object, the present invention provides a theft-deterrent tape measure package, comprising a tape measure device having a coilable tape rule contained in a housing and a belt clip secured to the housing, the tape measure device mounted on one side of a cardboard backing. The cardboard backing has an opening therethrough for receiving the belt clip. A blister pack is disposed on a side of the backing opposite the one side, the blister pack including first and second molded sheet portions bonded together. The belt clip is secured to the blister pack between the first and second sheet portions. An electronic article surveillance tag is secured between the first and second molded sheet portions, the blister pack being made from high strength plastic material inhibiting separation thereof from the belt clip and inhibiting manual access to the electronic article surveillance tag. The surveillance tag carrier structure requires cutting or otherwise destroying of the plastic material with an implement to enable separation thereof from the belt clip or manual access to the electronic surveillance tag.

In a specific embodiment, the package employs a blister pack having two compartments, one for securing the tape measure belt clip, and the other for securing the EAS tag. Specifically, the present invention provides a theft-deterrent tape measure package, comprising a tape measure device having a coilable tape rule contained in a housing and a belt clip secured to the housing, the tape measure device mounted on one side of a cardboard backing, and the cardboard backing having an opening therethrough for receiving the belt clip. A blister pack is disposed on a side of the backing opposite the one side, the blister pack including first and second molded sheet portions bonded together and forming first and second compartments. The belt clip is secured to the blister pack between the first and second sheet portions and disposed within the first compartment. The blister pack forms a clip opening engagement structure that engages within the opening formed in the belt clip when the belt clip is disposed within the first compartment to prevent removal of the belt clip from the first compartment. An electronic article surveillance tag is secured between the first and second molded sheet portions and disposed within the second compartment. The blister pack is made from high strength plastic material inhibiting separation thereof from the belt clip and inhibiting manual access to the electronic article surveillance tag. The surveillance tag carrier structure requires cutting or otherwise destroying of the plastic material with an implement to enable separation thereof from the belt clip or manual access to the electronic surveillance tag.

Other objects, features, and characteristics of the present invention as well as the methods of operation and functions of the related elements of structure will become apparent upon consideration of the following description and the appended claims with reference to the accompanying drawings, all of which form part of this specification, wherein like reference numerals designate corresponding parts in the various figures.

DETAILED DESCRIPTION OF THE PREFERRED EMBODIMENT

Figure 1:
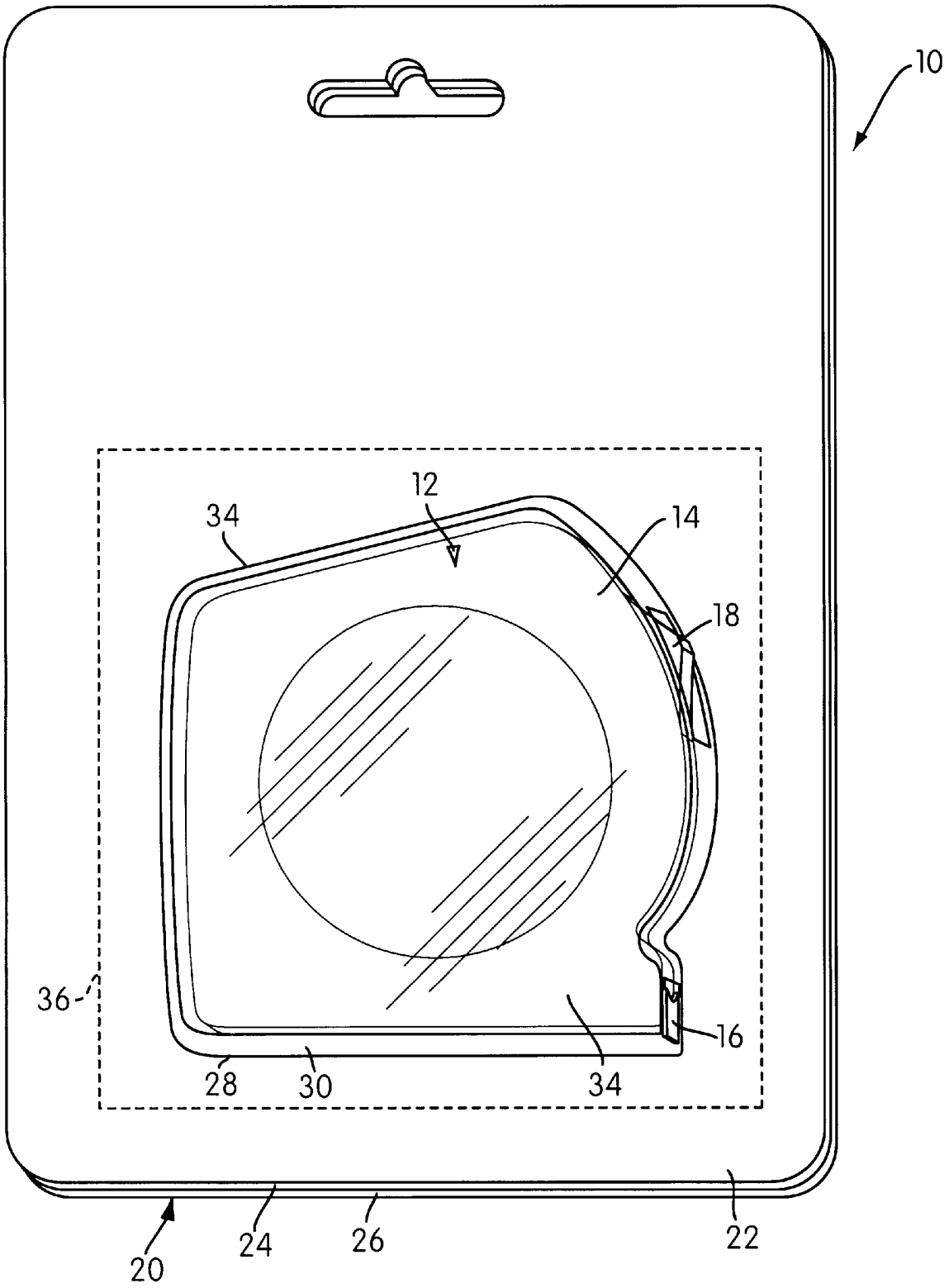
FIG. 1 is a front perspective view of a theft deterrent tape rule package in accordance with the principles of the present invention.

FIG. 1 is front perspective view of a tape rule package, generally indicated at 10, in accordance with the present invention. A tape rule device 12 having a housing 14 contains a coiled measuring tape, or measuring rule, therein. A hooked or flanged end 16 of the measuring tape is illustrated in FIG. 1. The coiled measuring tape is biased in a take-up direction in conventional fashion. The tape can also be locked in an extending measuring condition by actuation of the locking lever 18, also in conventional fashion.

The tape rule device 12 is contained in packaging 20. The packaging 20 comprises a large cardboard backing 22. The cardboard backing 22 is comprised of two cardboard sheets, including a front cardboard sheet 24 and a back cardboard sheet 26, which are adhered to one another. The front cardboard sheet 24 has within its boundary a cutout portion defined by edge 28, which generally conforms to the peripheral shape of the housing 14 (but is slightly larger). Thus, the housing 14 rests against a forwardly-facing surface 30 of the back cardboard sheet 26.

More particularly, the housing 14 of the tape rule device 12 is contained between the forwardly-facing surface 30 of the back cardboard sheet 26 and a clear plastic covering 34. The clear plastic covering 34 extends across the forward face of the housing 14 and then downwardly alone the edges of the housing 14 towards the edge 28. The clear plastic covering 34 has an outwardly-extending peripheral flange 36 which extends between the front cardboard sheet 24 and back cardboard sheet 26 and is adhered therebetween, to effectively secure the clear plastic covering 34 over the housing 14.

Figure 2:
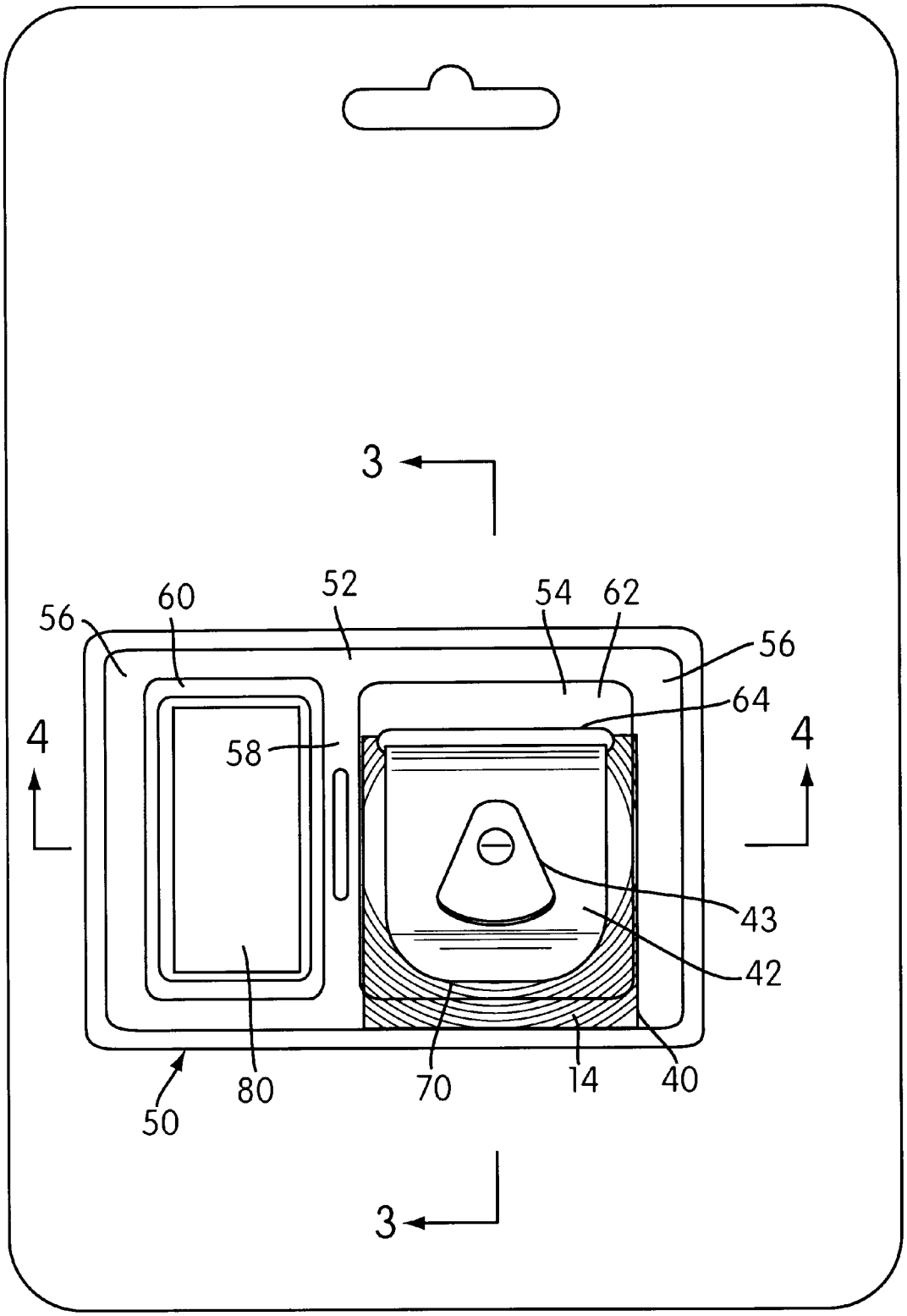
FIG. 2 is a rear perspective view of the theft deterrent tape rule package in accordance with the principles of the present invention.
Figure 3:
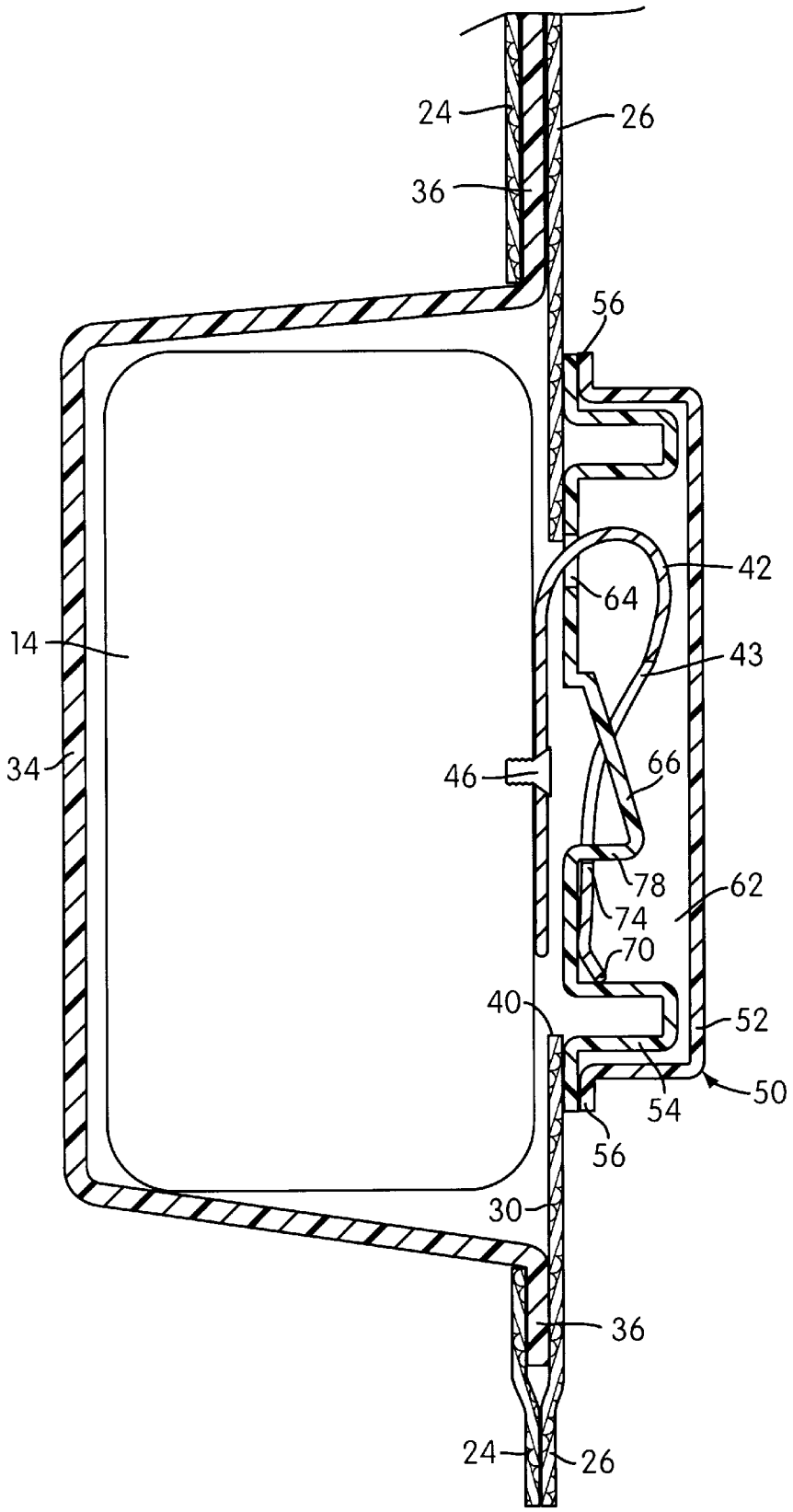
FIG. 3 is a cross-sectional view taken through the line 3—3 in FIG. 2.
Figure 4:
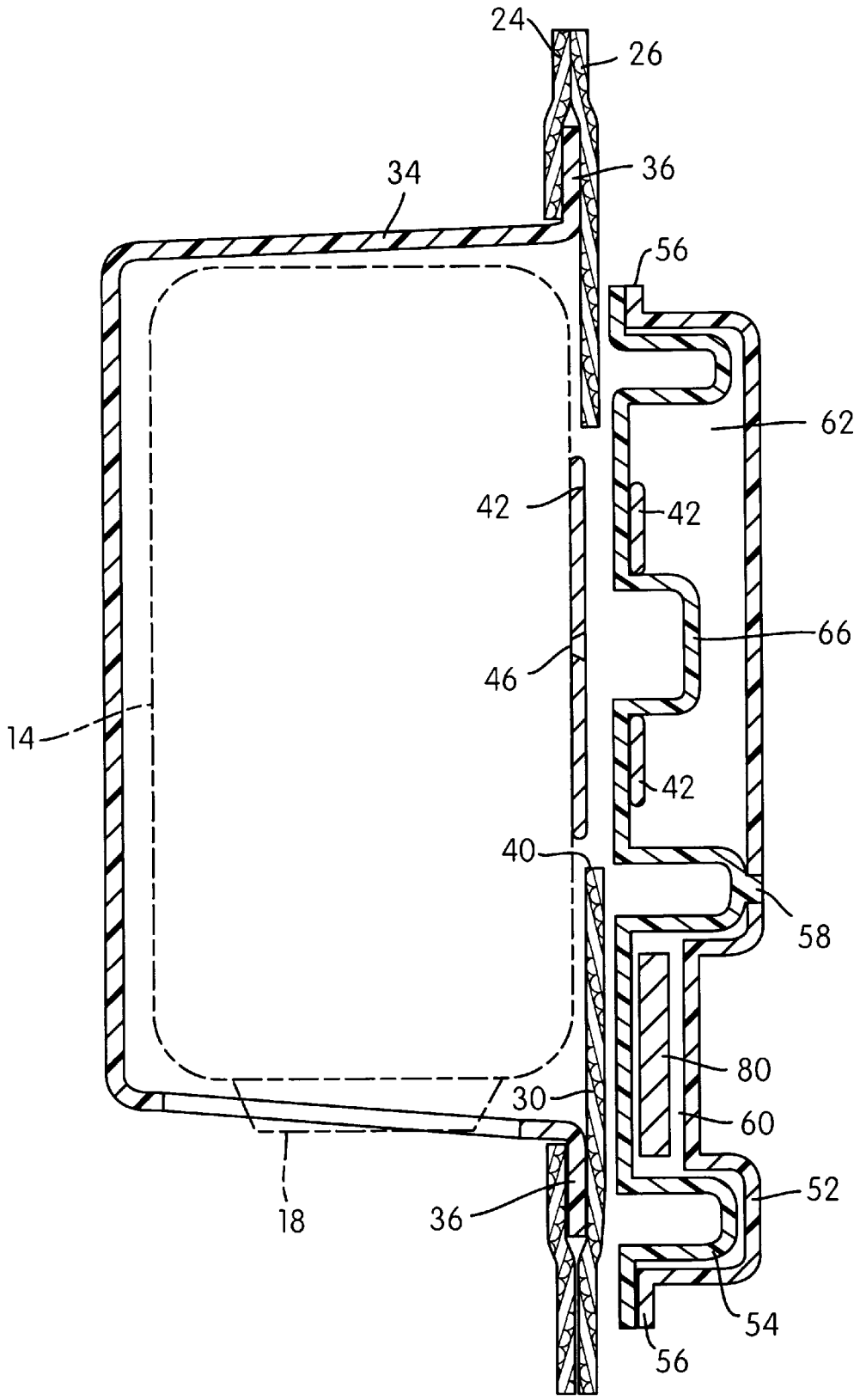
FIG. 4 is a cross-sectional view taken through the line 4—4 in FIG. 2.

FIG. 2 is a perspective view of the back side of the tape rule package 10. As shown, the back cardboard sheet 26 has a generally rectangular shaped opening 40, which is smaller than the opening or cut-out portion in the front sheet 24 defined by edge 28. A tape rule clip 42 is shown fastened to the tape rule housing 14 by an appropriate fastener 46. The clip 42 has a generally rectangular opening 43 stamped therethrough. The clip 42 extends at least partially outwardly through the opening 40 of the back cardboard sheet 26.

A separately-formed plastic structure for carrying an EAS tag is provided, as generally indicated at 50. Preferably, the structure employed is what is known in the art as a "blister pack," although any high strength plastic structure that can secure the EAS tag to the belt clip 42 can be used.

The blister pack 50 is formed as a completed unit prior to being secured to clip 42. The blister pack 50 is formed from a clear plastic material. Particularly, the blister pack 50 comprises two molded plastic sheet portions, including an outer sheet 52 and an inner sheet 54, which are peripherally heat-sealed (e.g., to cause slight plastic melting and then bonding solidification as known in the blister pack art) to one another along peripheral bond or seal 56. The sheet portions 52 and 54 may be separately formed, or hinged an folded-over to be sealed to one another.

Preferably, an intermediate seal 58 secures the inner sheet 54 to the outer sheet 52, and divides the interior space between the inner sheet 54 and outer sheet 52 into two separate compartments or spaces 60 and 62. The compartment 62 receives the clip 42 through a clip insertion opening 64 formed in the inner sheet 54 and communicating with the compartment 62, which functions as a clip-receiving compartment.

The inner sheet 54 has formed therein a clip opening engagement structure, preferably in the form of a ramp or bubble 66, which extends inwardly into the compartment 62. The ramp 66 extends further inwardly into compartment 62 as it extends further downwardly towards the bottom of the package (towards the bottom of the sheet in FIG. 2). To secure the clip 42 to the blister pack 50, the blister pack 50 is manipulated so that the opening 64 receives the leading edge 70 of the clip 42. The blister pack 50 is slid in an upward direction (towards the top of the page in FIG. 2), so that the leading edge 70, which is preferably bent slightly outwardly, rides up the increasing slope of the ramp 66. During this sliding motion, the clip 42 is biased slightly outwardly away from the housing 14, until the lower edge 74 of the opening 43 in the clip 42 snaps over the bottom edge 78 of the ramp 66. The ramp 66 is subsequently trapped within compartment 62. The bottom edge 78 of the ramp 66 prevents the clip 42 from backing out through opening 64. As a result, the blister pack 50 is securely fastened to the tape rule device 12. Thus, the plastic sheets forming the compartment 62 define a clip securement structure. It can be appreciated that the ramp configuration permits the lip to be easily inserted into the compartment 62 without the necessity of tools of any sort.

The second compartment 60, which functions as a surveillance tag carrier structure, contains an electronic article surveillance (EAS) tag 80, which is conventionally known and which utilizes magnetically vibrating elements that transmit a frequency which can be detected by a conventional detection system used in retail stores. Examples of such sensors are found in U.S. Pat. Nos. 5,357,240; 5,313,192; 5,111,186; 4,510,489; and 4,510,490, the respective disclosures of which are hereby incorporated by reference. The EAS tag can be disarmed, for example, by being demagnetized at the cash register before the customer walks past the sensor at the store exit.

The substance forming the blister pack 50 is made of a strong plastic material which cannot be manually ripped or torn. Thus, the blister pack 50 and hence the EAS tag cannot be removed from the clip 42 unless the material of the blister pack is cut or otherwise destroyed, which typically requires a tool, such as a sharp edge blade or scissors. Preferably, the plastic material is a polyvinylchloride (PVC) film, having a thickness between about 0.01–0.03 inches. Most preferably, the film has a thickness of about 0.02 inches. The PVC film used is preferably of the non-recycled variety to ensure strength thereof. The high strength plastic material inhibits separation thereof from said belt clip and inhibits manual access to said electronic article surveillance tag.

It can be appreciated that the present invention contemplates that the surveillance tag carrier structure or blister pack 50 can be provided with only a single compartment, rather than two separate compartments, and that the EAS tag and the belt clip can be secured in the same single compartment.

Preferably, the surveillance tag carrier structure or blister pack 50 is of a dimension greater than that of the opening 40 in the rear cardboard sheet 26 of the cardboard backing 22 so that 1) the cardboard backing 22 is secured between the housing 14 and the surveillance tag carrier structure 50, and 2) the blister pack 50 remains on an opposite side of the cardboard backing 50 in relation to the housing 14. As a result, the housing 14 is secured to the cardboard backing 22 without relying on, or even requiring, clear plastic covering 34.

While the invention has been described in connection with what are presently considered to be the most practical and preferred embodiments, it is to be understood that the invention is not to be limited to the disclosed embodiments, but on the contrary is intended to cover various modifications and equivalent arrangements included within the spirit and scope of the appended claims.

What is claimed is:

1. A theft-deterrent tape measure package, comprising:

a tape measure device including a coilable tape rule contained in a housing, and a belt clip secured to said housing;

a surveillance tag carrier structure secured to said belt clip and defining a compartment; and an electronic article surveillance tag secured within said compartment, said surveillance tag carrier structure being of high strength plastic material inhibiting separation thereof from said belt clip and inhibiting manual access to said electronic article surveillance tag, said surveillance tag carrier structure requiring cutting or otherwise destroying of said plastic material with an implement to enable separation thereof from said belt clip or manual access to said electronic surveillance tag.

2. A theft-deterrent tape measure package according to claim 1, wherein said surveillance tag carrier structure comprises a blister pack.

3. A theft-deterrent tape measure package according to claim 2, wherein said blister pack comprises two molded plastic sheets bonded together.

4. A theft-deterrent tape measure package according to claim 1, wherein said belt clip is provided with a belt clip opening, and wherein said surveillance tag carrier structure is molded from a plastic material so as to be provided with a projection that projects through said belt clip opening to enable said surveillance tag carrier structure to be secured to said belt clip.

5. A theft-deterrent tape measure package according to claim 1, wherein said surveillance tag carrier structure is formed with two compartments, including said compartment in which said electronic article surveillance tag is secured, and a separate compartment that receives said belt clip.

6. A theft-deterrent tape measure package according to claim 1, further comprising a cardboard backing having an opening, housing disposed on one side of said cardboard backing, and said belt clip extending through said opening to a side of said backing opposite said one side, said surveillance tag carrier structure secured to said belt clip being disposed on said opposite side of said cardboard backing and being of a dimension greater than that of said opening so that said cardboard backing is secured between said housing and said surveillance tag carrier structure.

7. A theft-deterrent tape measure package, comprising:

a tape measure device having a coilable tape rule contained in a housing and a belt clip secured to said housing;

a cardboard backing, said tape measure device mounted on one side of said cardboard backing, said cardboard backing having an opening therethrough for receiving said belt clip;

a blister pack disposed on a side of said backing opposite said one side, said blister pack including first and second molded sheet portions bonded together, said belt clip secured to said blister pack between said first and second sheet portions; and an electronic article surveillance tag secured between said first and second molded sheet portions, said blister pack being made from high strength plastic material inhibiting separation thereof from said belt clip and inhibiting manual access to said electronic article surveillance tag, said surveillance tag carrier structure requiring cutting or otherwise destroying of said plastic material with an implement to enable separation thereof from said belt clip or manual access to said electronic surveillance tag.

8. The theft-deterrent tape measure package of claim 7, wherein said belt clip includes an opening formed therein, and said blister pack includes clip opening engagement structure extending through said belt clip opening for securing said blister pack to said belt clip.

9. The theft-deterrent tape measure package of claim 8, wherein said blister pack comprises a belt clip receiving opening that permits said belt clip to be inserted into a space between said sheet portions after said sheet portions are bonded to one another, said belt clip including a leading edge bent outwardly with respect to said housing, and wherein said clip opening engagement structure comprises a ramp surface constructed and arranged so that, as said belt clip is inserted into said clip receiving opening, said ramp surface slides beneath said leading edge of said belt clip, and as said belt clip is continuously inserted into said space, said belt clip rides up said ramp surface and is resiliently bent away from said housing until an edge portion of said opening of said belt clip passes over an upper edge of said ramp surface to permit said belt clip to resiliently return toward said housing to its original position, with said clip opening engagement structure received in said opening of said belt clip, and wherein said edge portion of said belt clip engages said clip opening engagement structure to prevent said belt from being withdrawn from said first compartment.

10. The theft-deterrent tape measure package of claim 9, wherein said first and second molded sheet portions define first and second compartments, said first compartment providing said space into which said belt clip is inserted, and wherein said electronic article surveillance tag is carried in said second compartment.

11. The theft-deterrent tape measure package of claim 7, wherein said cardboard backing includes front and back sheets of cardboard, each of said sheets of cardboard having a cut-out portion so as to provided said opening through said cardboard backing, said cut-out portion of said front sheet of cardboard being of a greater dimension than the cut-out portion of said back sheet of cardboard, said cut-out portion of said front sheet of cardboard being defined by an peripheral edge generally surrounding the periphery presented by said housing of said tape measure device to enable the housing to rest against a front surface of said back sheet of cardboard, said cut-out portion of said back sheet of cardboard permitting said belt clip to extend therethrough for securement to said blister pack.

12. The theft-deterrent tape measure package of claim 11, further comprising a clear plastic covering extending over said housing and secured between the front and back sheets of cardboard.

13. The theft-deterrent tape measure package of claim 11, wherein said blister pack is of a greater dimension than that of said cut-out portion of said back sheet of cardboard so as to ensure a) that said blister pack remains on said opposite side of said cardboard backing, and b) that said cardboard backing is retained between said housing and said blister pack.

14. A theft-deterrent tape measure package, comprising:

a tape measure device having a coilable tape rule contained in a housing and a belt clip secured to said housing;

a cardboard backing, said tape measure device mounted on one side of said cardboard backing, said cardboard backing having an opening therethrough for receiving said belt clip;

a blister pack disposed on a side of said backing opposite said one side, said blister pack including first and second molded sheet portions bonded together and forming first and second compartments, said belt clip secured to said blister pack between said first and second sheet portions and disposed within said first compartment, said blister pack forming a clip opening engagement structure that engages within said opening formed in said belt clip when said belt clip is disposed within said first compartment to prevent removal of said belt clip from said first compartment; and an electronic article surveillance tag secured between said first and second molded sheet portions and disposed within said second compartment, said blister pack being made from high strength plastic material inhibiting separation thereof from said belt clip and inhibiting manual access to said electronic article surveillance tag, said surveillance tag carrier structure requiring cutting or otherwise destroying of said plastic material with an implement to enable separation thereof from said belt clip or manual access to said electronic surveillance tag.

15. A theft-deterrent tape measure package according to claim 14, wherein said blister pack secured to said belt clip is of a dimension greater than that of said opening in said cardboard backing so that said cardboard backing is secured between said housing and said blister pack.

16. The theft-deterrent tape measure package of claim 15, further comprising a clear plastic sheet covering said housing of said tape rule device and secured to the cardboard backing.

17. The theft-deterrent tape measure package of claim 16, wherein said cardboard backing includes front and back sheets of cardboard, each of said sheets of cardboard having a cut-out portion so as to provided said opening through said cardboard backing, said cut-out portion of said front sheet of cardboard being of a greater dimension than the cut-out portion of said back sheet of cardboard, said cut-out portion of said front sheet of cardboard being defined by an peripheral edge generally surrounding the periphery presented by said housing of said tape measure device to enable the housing to rest against a front surface of said back sheet of cardboard, said cut-out portion of said back sheet of cardboard permitting said belt clip to extend therethrough for securement to said blister pack.

* * * * *